United States Patent [19]

Nickel

[11] Patent Number: 5,009,371

[45] Date of Patent: Apr. 23, 1991

[54] ROTARY DISINTEGRATING DEVICE

[75] Inventor: Klaus-Dietrich Nickel, Frankfurt am Main, Fed. Rep. of Germany

[73] Assignee: Citadel Investments Limited, St. Helier Jersey, Channel Islands

[21] Appl. No.: 423,439

[22] PCT Filed: Jan. 25, 1989

[86] PCT No.: PCT/DE89/00040

§ 371 Date: Sep. 27, 1989

§ 102(e) Date: Sep. 27, 1989

[87] PCT Pub. No.: WO89/07012

PCT Pub. Date: Aug. 10, 1989

[30] Foreign Application Priority Data

Jan. 27, 1988 [DE] Fed. Rep. of Germany ..... 3802260

[51] Int. Cl.[5] ..... B02C 13/20

[52] U.S. Cl. ..... 241/187; 241/188 R; 241/197

[58] Field of Search ..... 241/187, 188 R, 188 A, 241/284, 195, 197

[56] References Cited

U.S. PATENT DOCUMENTS

| | | | |
|---|---|---|---|
| 3,771,734 | 11/1973 | Stephenson et al. . | |
| 3,894,695 | 7/1975 | Benedikter | 241/188 R |
| 4,406,409 | 9/1983 | Durek | 241/188 R |
| 4,747,551 | 5/1988 | Shagarova et al. | 241/188 R |

FOREIGN PATENT DOCUMENTS

| | | | |
|---|---|---|---|
| 48012 | 3/1983 | European Pat. Off. . | |
| 625873 | 2/1936 | Fed. Rep. of Germany . | |
| 949794 | 9/1956 | Fed. Rep. of Germany . | |
| 1296943 | 6/1969 | Fed. Rep. of Germany . | |
| 2833688 | 2/1979 | Fed. Rep. of Germany | 241/188 A |
| 1126321 | 11/1984 | U.S.S.R. | 241/188 A |

*Primary Examiner*—Mark Rosenbaum

*Attorney, Agent, or Firm*—Toren, McGeady & Associates

[57] ABSTRACT

A rotary disintegration apparatus comprises a housing with a central material input and a material outlet that is open underneath, an inner rotor fixed to a first shaft and an outer rotor fixed to a second shaft on the same axis that rotates in the opposite direction, and blade rings that follow each other in alternation having blades which are inclined in the direction of rotation, which can be coated with a protective layer, which have front and rear edges of hard wear-resistant material, and which sit on one side on retaining rings and on the other side on assembly rings forming replaceable components of annular assembly ring carriers that are connected to the shafts. The blades are so arranged at a distance from the edges of the assembly and retaining rings of their blade rings that the front edges of the blades of a blade ring and the rear edges of the blades of the following blade ring which rotates in the opposite direction define annular chambers within the disintegration chamber, within which, within the nominal speed range of the rotors, vortex zones of the gas-solids mixture are formed.

41 Claims, 9 Drawing Sheets

FIG. 2
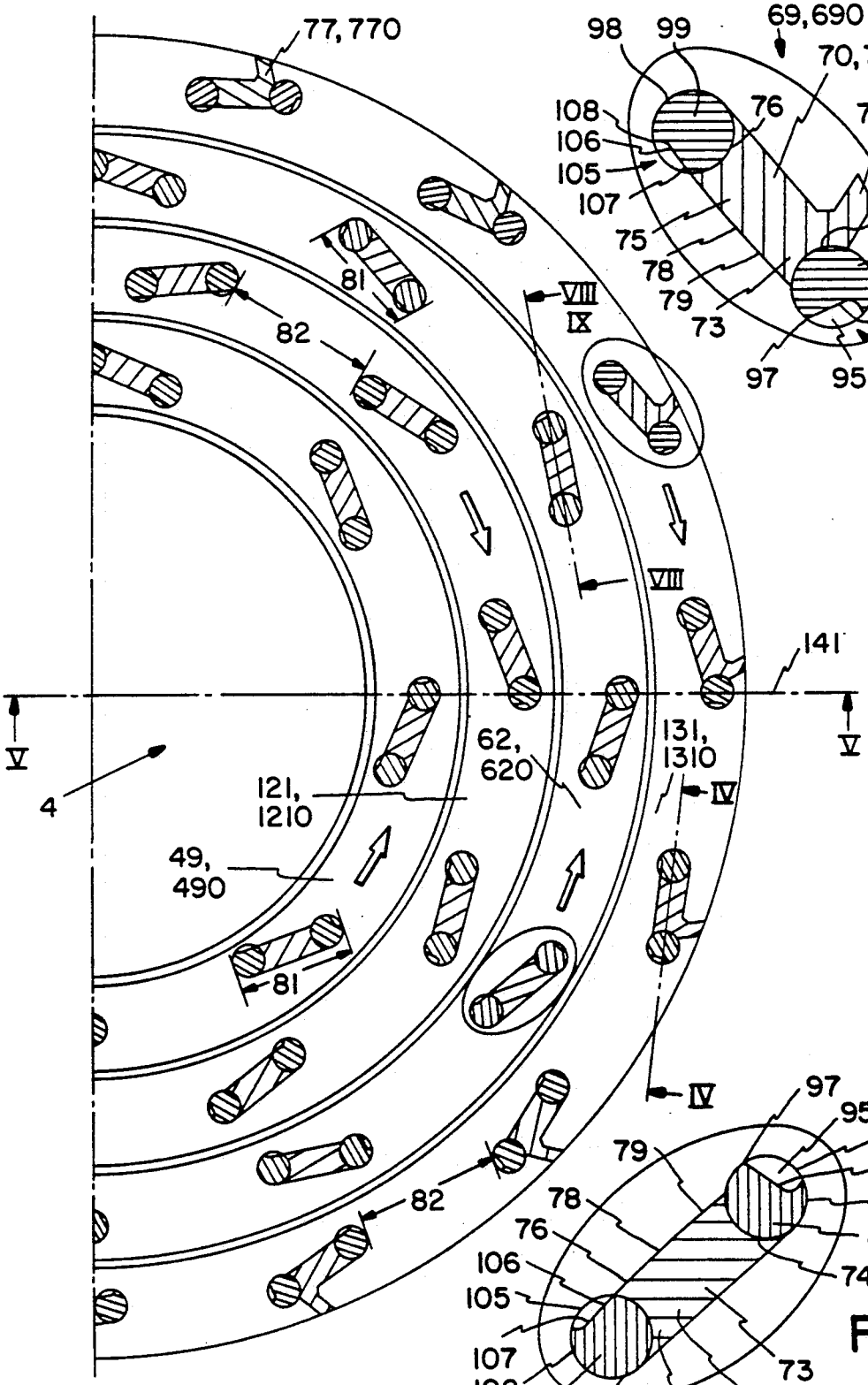
FIG. 3
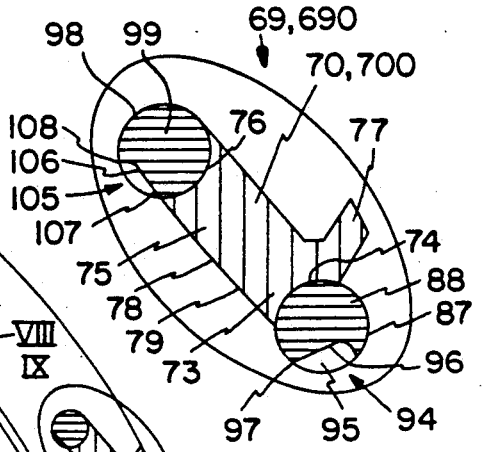
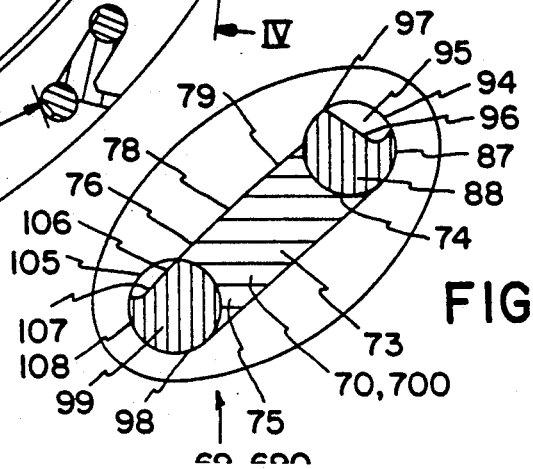
FIG. 4

ROTARY DISINTEGRATING DEVICE

The present invention relates to a rotary disintegration apparatus of the type having a central material input and a material outlet that is open at the bottom, located in a housing.

The apparatus consists of an inner rotor secured to a shaft and an outer rotor on a shaft on the same axis which is driven in the opposite direction, and blade rings that follow each other in alternation, the blades of which, inclined in the direction of rotation, are provided with a protective coating and with blades having front and rear edges of hard, wear-resistant material installed, on the one side on retaining rings and on the other, on assembly rings, which are replaceable components of annular assembly ring carriers connected to the shafts.

In such a disintegration apparatus, for example as described in DE-AS 12 69 943, used to reduce hard material that is inclined to build up and cake, in particular sand, iron ore, and mixtures that contain these materials, the material is driven from the inside outwards by continuous impact on the blades. The blades are set at a specific inclination in the direction of rotation, towards the front and towards the outside. The preferred angle of inclination between the peripheral direction and the planes of the blades, measured on the front edge of the blade, is between 20 and 30°. Optimal inclined dimensioning occurs with this blade inclination if, at the same time, the front and rear edges of the blades lie on the contour line of their retaining or assembly rings. These special features of the known disintegration apparatus are regarded not only as a prerequisite for good reduction work, but also for the fact that solid and durable protective layers of the material that is to be reduced form on the working surfaces of the blades, these layers being intended to protect the blades from rapid wear. Because of the formation of these protective layers, the impact effect takes place mainly on the surfaces of these protective layers.

If the blades with a smaller inclined dimension than corresponds to the width of the retaining or installation rings in the direction of the pitch angle of the blades are used, the reduction work that is done deteriorates to the point that even with twice the number of blades, one cannot achieve the advantages that can be achieved with blades that are not so wide. The accumulation of protective layers is significantly better with wider blades and the preferred pitch angle.

Even though these protective layers on the blades are of good quality and protect the blades from rapid wear, this known rotary disintegration apparatus does have some disadvantages.

As a result of the larger dimensions to the blades that are preferred for the formation of the protective layers, only very narrow deflection zones for the material that is to be reduced result between the blade rings that follow each other in alternation, and the result of this is the fact that the nominal speed range of the known rotary disintegration apparatus is relatively low. The reduction performance is limited by this fact. In addition, there is the special design construction of the known disintegration apparatus. The blades of the blade ring are, in each instance, secured to two parallel annular disks (retaining ring and assembly ring) which, in each instance, lie with the annular disks of the remaining blade rings in a plane that is perpendicular to the axis. The annular disks that are associated with the inner or the outer rotor, respectively, are joined to each other by spokes, preferably by a threaded connection. Although this is intended to make it easier to service the disintegrator—the blades can either be replaced or rotated through 180 in order to make use of the unused working surfaces—one must, however, accept flow-technology inadequacies in the relatively low working speed range within the disintegrator, by which the formation of spray grain is facilitated. It is also unfavourable, from the point of view of flow technology, that the projecting heads of the particular screws that hold the individual parts of the rotor together cause undesired vortexes within the disintegrator.

The present invention is based on the knowledge that the service life of a disintegrator apparatus can be increased if it is possible to relieve the blades, which are the most heavily loaded parts within the disintegrator chamber, of the actual reduction work.

It is an object of the present invention to increase both the reduction performance and the service life of a rotary disintegrator apparatus and at the same time reduce the formation of spray grain to a minimum.

According to the present invention there is provided a rotary disintegration apparatus comprising a housing with a central material input and a material outlet open underneath, an inner rotor fixed to a first shaft and an outer rotor fixed to a second shaft on the same axis that rotates in the opposite direction, and blade rings that follow each other in alternation, said blade rings having blades which are inclined in the direction of rotation, which can be coated with a protective layer, which have front and rear edges of hard wear-resistant material, and which sit on one side on retaining rings and on the other side on assembly rings forming replaceable components of annular assembly ring carriers that are connected to the shafts, said blades being so arranged at a distance from the edges of the assembly and retaining rings of their blade rings that the front edges of the blades of a blade ring and the rear edges of the blades of the following blade ring which rotates in the opposite direction define annular chambers within the disintegration chamber, within which, within the nominal speed range of the rotors, vortex zones of the gas-solids mixture are formed.

Even though the number of alternating blade rings that follow each other in alternation from the inside to the outside is neither prescribed nor limited by the invention, a preferred embodiment of the present invention operates with four blade rings. In this case, three annular vortex zones are formed within the disintegration chamber out as far as the fourth blade ring, through which the solid particles are driven from the inside to the outside. Within these vortex zones, the solid particles impact on each other at extremely great speeds. This liberates a considerable amount of reduction energy, which causes the solids particles to almost burst without the particle surfaces being compressed as was formerly the case with pebble mills. The blades, and in particular the protective layers that form on the working surfaces, are only involved in the reduction work to a relatively small degree. The greatest loading of these protective layers results only from contact with the solid particles during their radial migration from blade ring to blade ring, whereupon a movement component that is more or less transverse to the centrifugal direction is imparted to the particles from the blades.

According to the present invention, in addition, the disintegration chamber with its three vortex zones also includes an outer impact chamber that is defined inwards by the front edges of the blade of the outer blade ring and outwards by the end or face wall that connects the side walls of the housing. In the nominal speed range, an additional vortex zone is formed within this outer impact chamber. Within this relatively large impact chamber there is not only a considerable amount of reduction work but primarily there is an effect or activation of the reduced material and, in particular, a substance exchange between the gas which is to be determined specifically and the solid particles.

Also of great significance from the flow-technology point of view is the configuration of the disintegration chamber beneath the impact chamber. The inner surfaces of the retaining and assembly rings that follow one another in alternation are smooth and form the side walls of the disintegrating chamber, which grow wider towards the outside, from blade ring to blade ring, up to and as far as the impact chamber. This widening of the impact chamber means that the width of the blades in the blade rings becomes larger from the inside to the outside.

Allowance is made for the increased volume of the gas-solids mixture that takes place during the reduction by this widening of the disintegration chamber.

Essentially, each rotor consists of an assembly ring carrier that is flange mounted on the associated shaft. In the preferred embodiment, each of these assembly ring carriers bears two concentric assembly rings Each assembly ring carrier also has an annular bulge into which project the retaining rings of those blade rings that have their assembly rings secured to the other assembly ring carriers. In each instance, one of these annular bulges in each rotor is configured as an annular pressure relief chamber. These annular pressure relief chambers have annular bottoms that incorporate the pressure relief ports. These pressure relief ports ensure that during operation there is pressure equalization within the disintegration chamber and between the disintegration chamber and the areas within the housing, which lie between the inner surfaces of the housing side walls and the outer walls of the rotary disintegration apparatus.

It is advantageous that the pressure relief ports in the annular pressure relief chambers be covered by the retaining rings that project into them. Of particular importance for the disintegration apparatus according to the present invention is the fact that the side walls of the bulges, above all of the annular pressure relief chambers, as well as of the retaining rings that protrude into them, are formed as outer or inner truncated conical housings with, in each instance, the larger diameter of this truncated conical housing being arranged to face towards the disintegration chamber. This means that between the bottoms of the annular pressure relief chambers and the disintegration chamber there are narrow annular channels through which any solid particles that get into them can be returned into the disintegration chamber. This is considered to be an important advantage of the present invention, since the formation of spray grain will be prevented by these measures Any particles that get out of the disintegration chamber and which are removed from the reduction process are returned practically automatically into the disintegration chamber and moved on for further reduction work.

In order to permit proper pressure equalization, the edges of the pressure relief ports are chamfered on both sides. In a further embodiment of the present invention each annular pressure relief chamber has as many pressure relief ports as are necessary for maintaining the desired reduction of the gas temperature (which is dependent on rotational speed). For reasons of production technology, the pressure relief ports are usually circular, the diameter of the circular pressure relief ports extending as far as the edges of the bottom cf the annular pressure relief chambers. Pressure relief ports of other shapes can also be used without modifying the underlying concept of the invention. What is essential is that the total area of the pressure relief ports is great enough to bring about the desired pressure equalization without any disruption. The annular pressure relief chambers with the pressure relief ports serve as buffer and pressure equalization chambers by which the gas pressure that builds up during the reduction process can be reduced. The measures according to the present invention that are used for pressure equalization certainly prevent any undesired process heat caused by excessive gas compression.

Accordingly, under favourable process and flow conditions within the disintegrator, because of the new disintegration apparatus according to the present invention, the main reduction work is not done by the blades of the blade rings. It has been shown that, depending on the peripheral speed of these blade rings, up to approximately 65% of the reduction work is done in the three vortex zones and in the impact chamber, the remaining reduction being carried out by contact between the solid particles and the blades. Optimal reduction performance within the vortex zones is achieved within the nominal speed range. Here, nominal speed range is understood to be not the nominal speed of the drive motors, but a speed range that is optimally suited for the specific weight of the disintegration material and its structure. It is desired that the peripheral speed of the blade ring at the center does not drop below 130 m/sec (260 m/sec in a counter-rotating system). Beneath this speed, a significant part of the reduction work is done by contact between the solid particles and the blades. Because of this, but also because of the loading in the area in the nominal speed range, the front and rear edges of the blades are very heavily loaded. For this reason, in the disintegrator according to the present invention, the blades are configured in a particularly advantageous manner by the easy replaceability of the edges, without the need to strip the rotor system.

According to the present invention, each blade consists of a center piece that is connected to the assembly ring and to the retaining ring of the particular blade ring and two hard wear-resistant front and rear edge rods that are adjacent to the center piece, and which can be combined with these rings so as to be releaseable.

In one embodiment of the present invention, the center pieces of the blades are bolted together with the retaining and assembly rings. In another embodiment, the retaining ring, the assembly ring, and the center piece of the blade of a blade ring are formed as a monolithic casting. However, in both embodiments, the front and the rear edge rods of the blades are easy to install and to remove. In both embodiments, the center piece of each blade is a flat plate with a front edge and a rear edge as viewed in the direction of rotation. Both edges have bulges within which the edge rods lie so as to dissipate the process heat. The dimensions of the retaining rings, the assembly rings and the blades are such that cast and bolted-up rotors can replace each other. For reasons of cost, cast rotors are always used if the particular angle of attack of the blades within the blade ring is established for a specific disintegration material. These angles of attack depend not only on the hardness, the specific weight, and the Hardgrove value of the materials that are to be reduced, but also on the nominal rotational speed of the rotary disintegration apparatus.

For reasons of flow-technology, all the bolts and screws that are used are configured as hexagon socket cap screws or are arranged in circular depressions that are covered over by covers.

The invention will now be described in more detail, by way of example only, with reference to the accompanying drawings in which:

FIG. 2 is the same partial plan view as in FIG. 1 but without showing the vortex zones;

FIG. 3 shows a structural detail of the apparatus;

Figure 5:
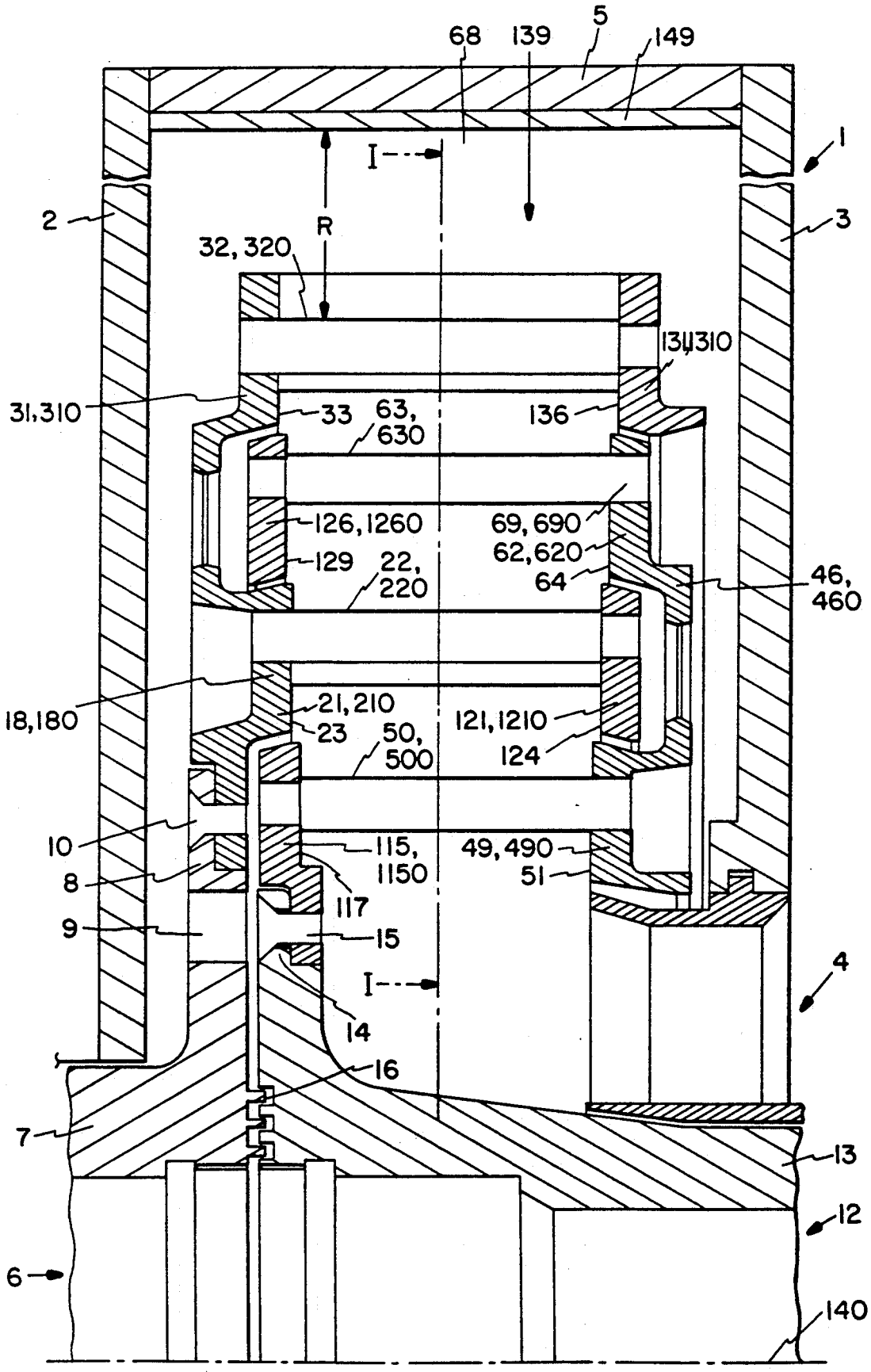
Figure 6:
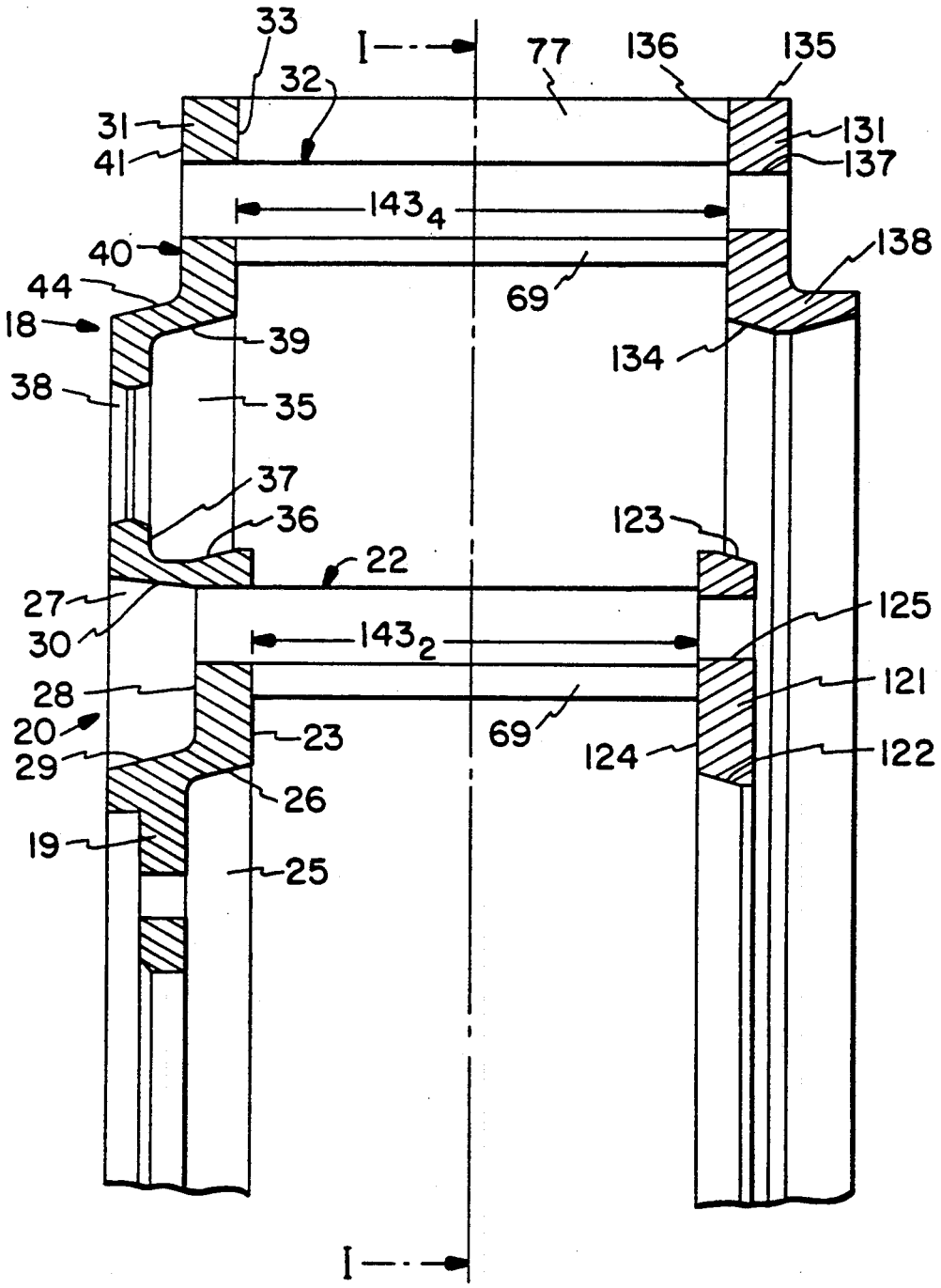
Figure 7:
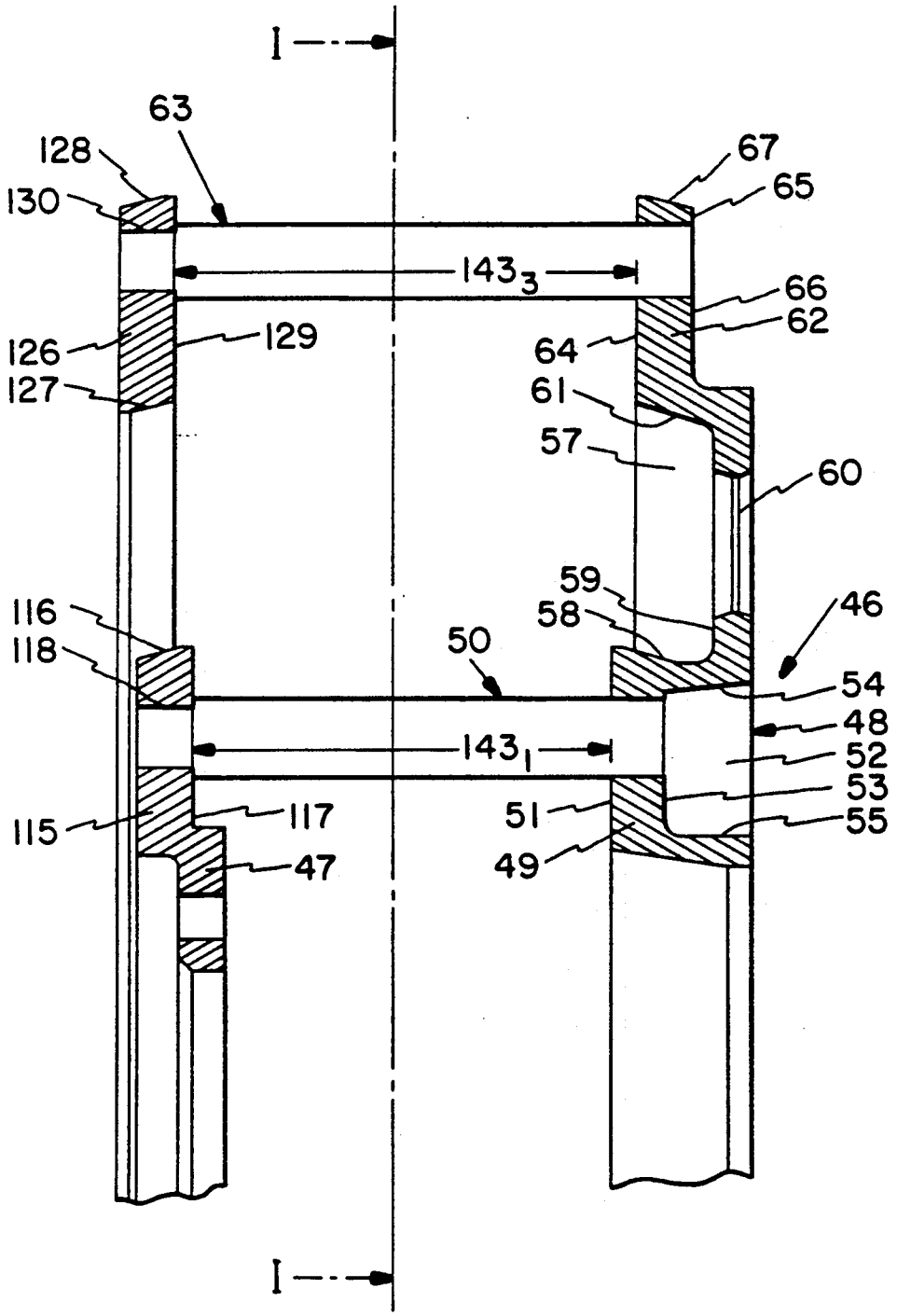
Figure 8:
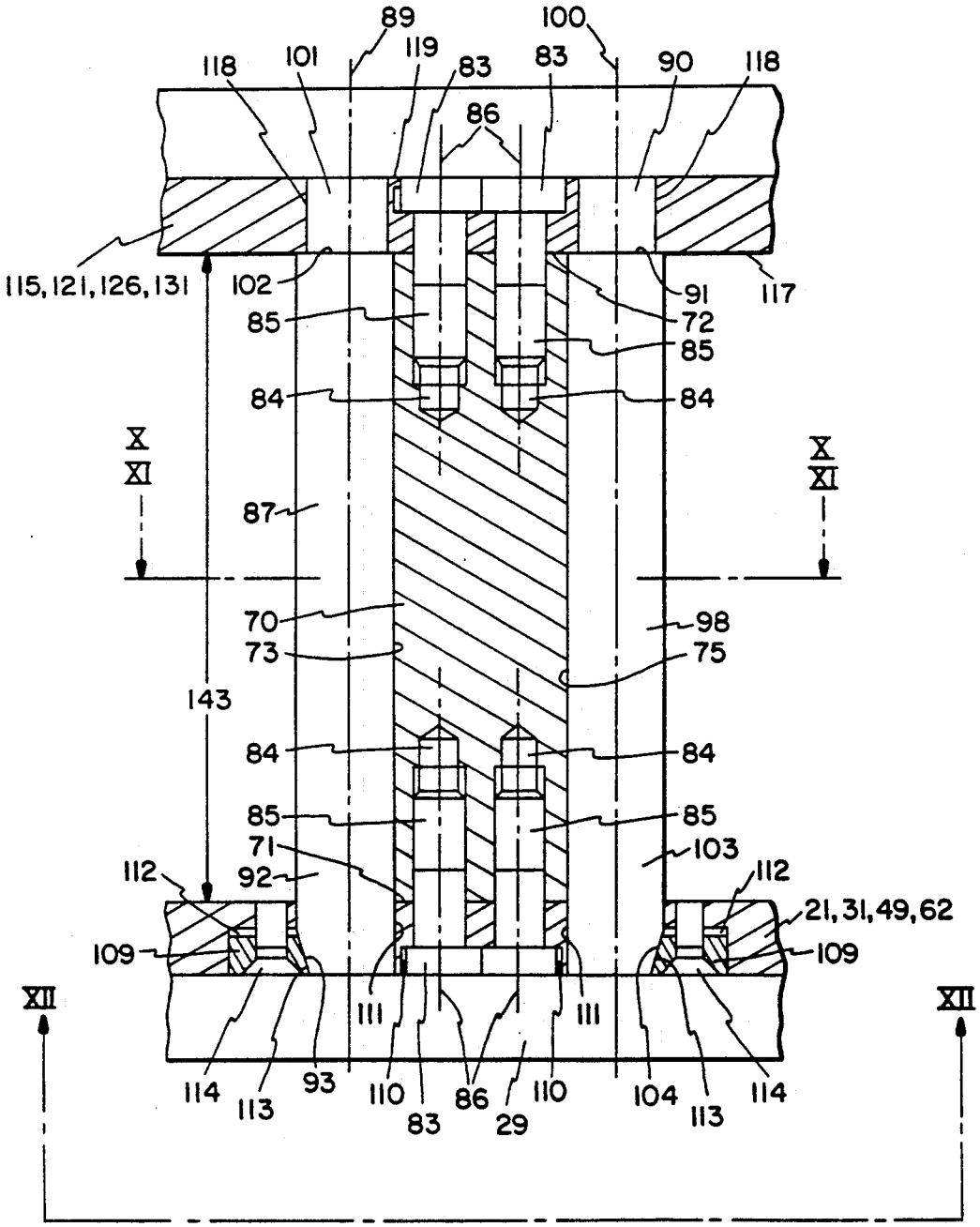
Figure 9:
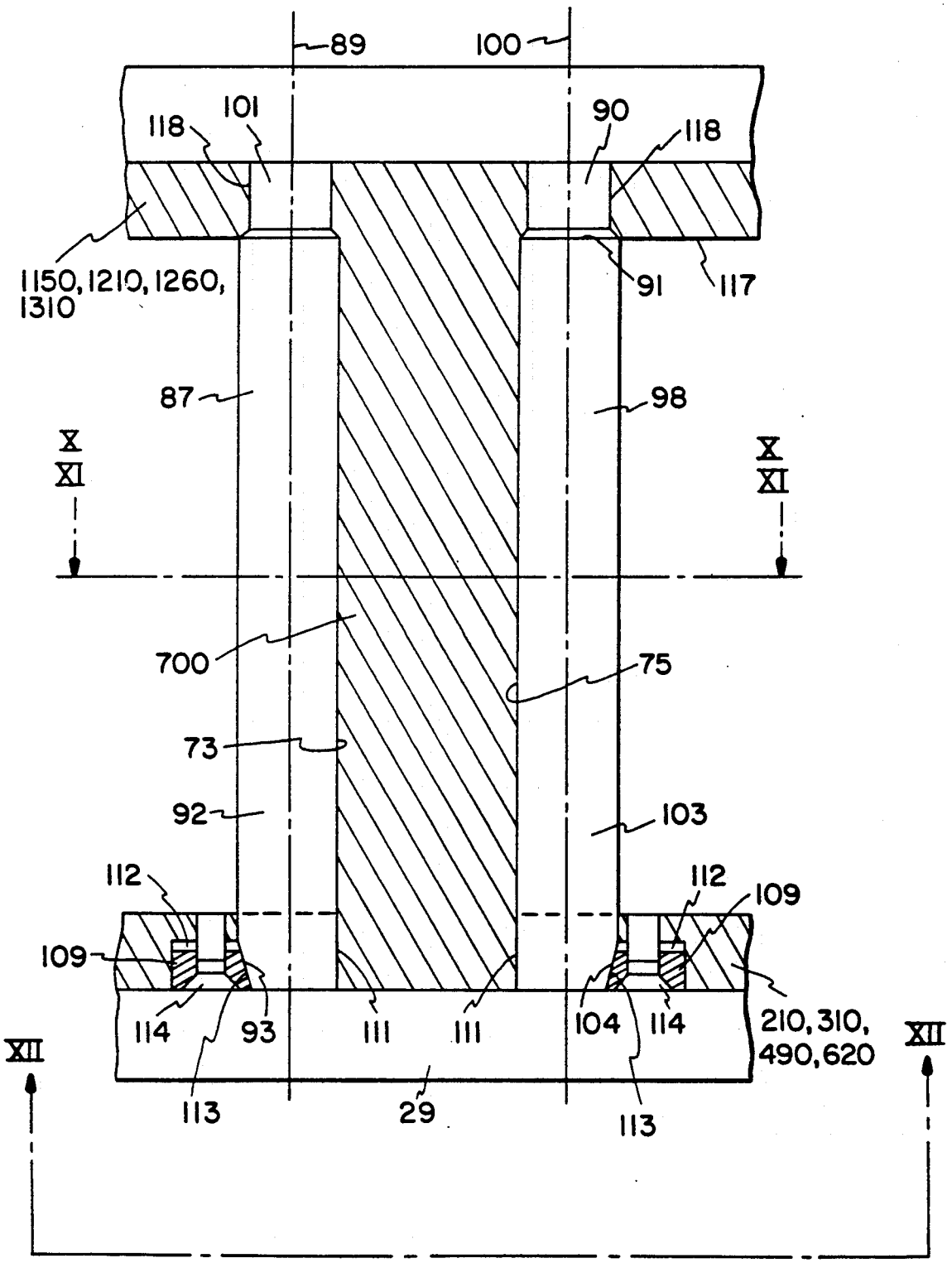
Figure 10:
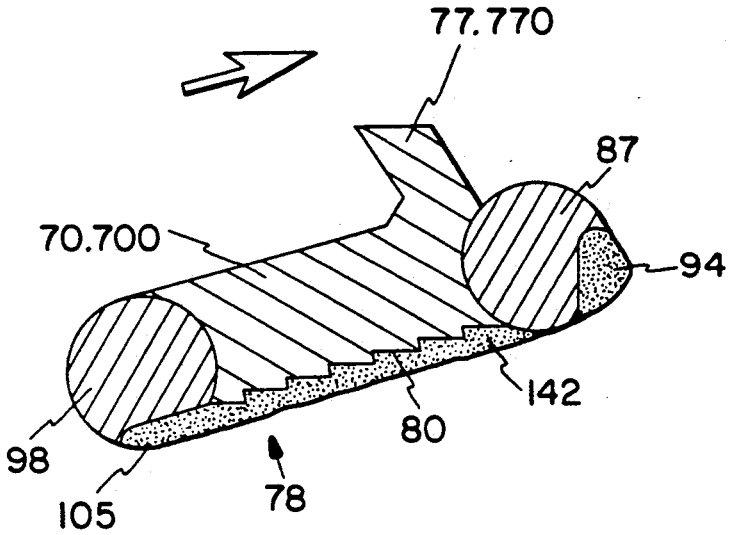
Figure 11:
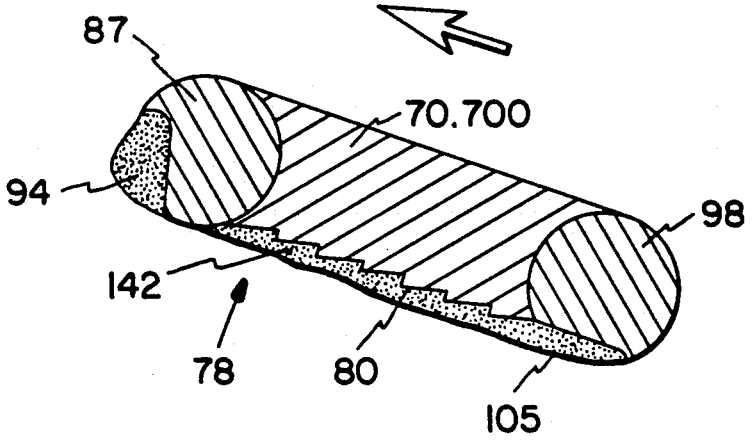

FIG. 4 also shows a structural detail of the apparatus;

FIG. 5 is a section on the line V—V in FIG. 2;

FIG. 6 is a partial view through the outer rotor;

FIG. 7 is a partial view through tho inner rotor;

FIG. 8 is a section along the line VIII—VIII in FIG. 2;

FIG. 9 is a cross section on the line IX—IX in FIG. 2;

FIG. 10 is a cross section on the line X—X in FIGS. 8 and 9;

FIG. 11 is a section along the line XI—XI in FIGS. 8 and 9; and

Figure 12:
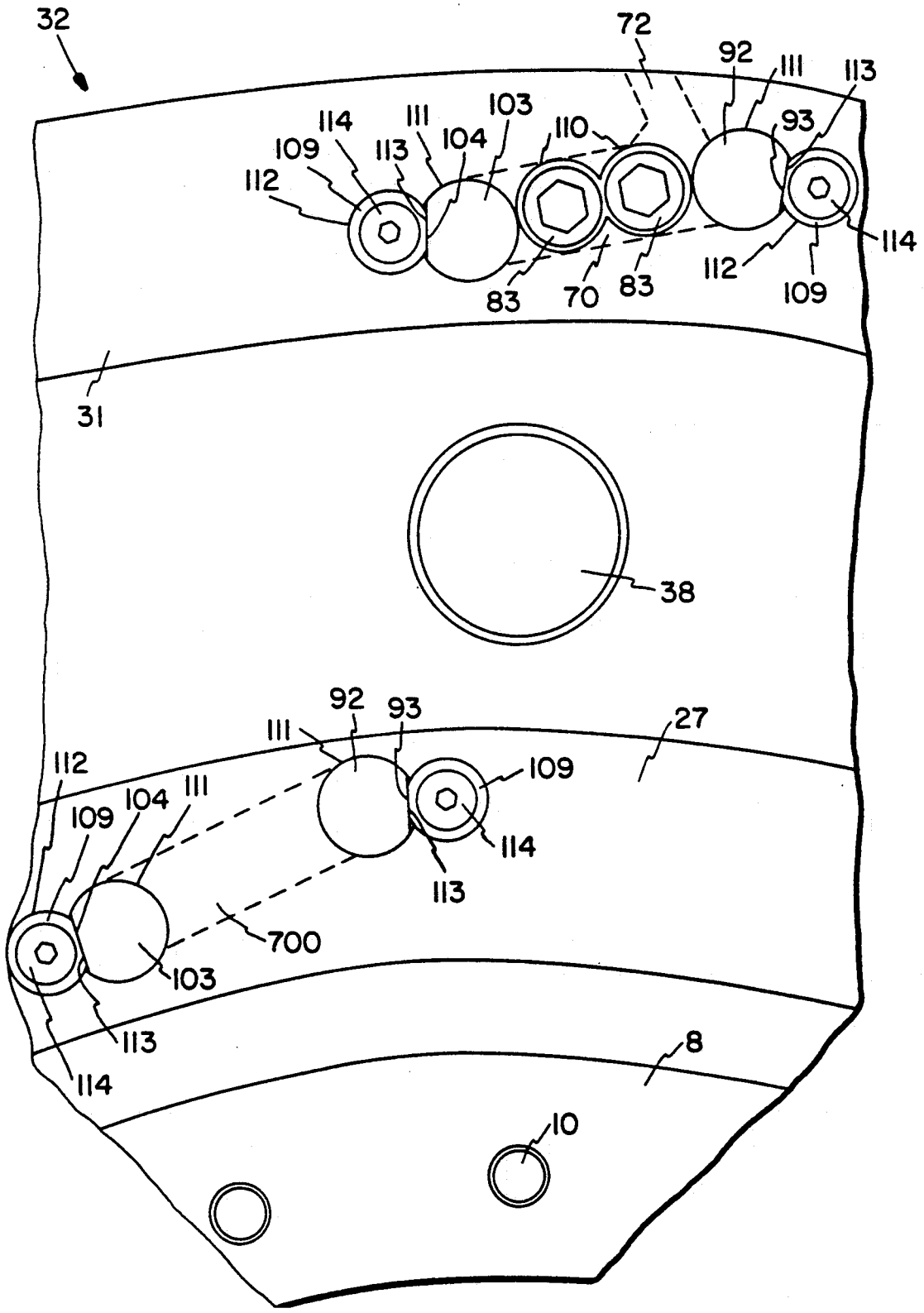

FIG. 12 is a diagrammatic view along the line XII—XII in FIGS. 8 and 9.

A rotary disintegration apparatus 1 according to the present invention consists of an outer rotor 18, 180 and an inner rotor 46, 460. The double numbering indicates that in each instance two rotors of identical dimensions but produced by different methods can be used. Each of the rotors that bear the lower number 18, 46 is bolted together from individual parts whereas, on the other hand, the rotor with the higher number 180, 460 is a monolithic casting made of up individual parts. For purposes of clarity, not all the parts of the rotors bear two numbers: what is important is the fact that the cast inner and outer rotors and those that are bolted together from individual parts can replace each other.

The disintegration of the solid particles takes place in a disintegration chamber 139, which includes an impact chamber 68, within a housing having a first housing side wall 2, a second housing side wall 3, and a housing end wall 5 that connects the housing walls 2 and 3 with each other and which can be clad in its interior with easily replaceable wear panels 149. A mixture of gas and the solid particles that are to be reduced is introduced into the rotary disintegration apparatus 1 through a central material input 4. The disintegrated material leaves the rotating disintegration apparatus 1 through a material outlet which is open at the bottom (not shown herein).

Four rotating blade rings that rotate in opposite directions and engage within each other alternately and in turns, work within the disintegration chamber 139. The inner first blade ring 50, 500 which rotates to the left (FIGS. 1 and 2) is followed by the second blade ring 22, 220 that rotates to the right, which is adjacent to the third blade ring 63, 630 that once again rotates to the left. The outer, fourth blade ring 32, 320 also rotates to the right. The second and the fourth blade rings 22, 220; 32, 320 are parts of the outer rotor 18, 180 and the first and the third blade ring 50, 500; 63, 630 are parts of the inner rotor 46, 460.

Without in any way changing the underlying concept of the invention, disintegration apparatuses with three or five blade rings or any other number of blade rings can be used.

The outer rotor 18, 180 is connected to a first shaft 6 with a flange end 7, which then becomes an annular shaft flange 8 (FIG. 5, FIG. 12) to which an annular flange 19 (FIG. 6) of the outer rotor 18, 180 is connected by means of the countersunk bolts 10.

The inner rotor 46, 460 is connected to a second shaft 12 with a flange end 13 which becomes an annular shaft flange 14 (FIG. 5) to which an annular flange 47 of the inner rotor 46, 460 is secured by means of countersunk screws 15. The screw heads of the countersunk screws 15 are accessible through drilled holes 9 in the annular shaft flange 8 of the first shaft 6.

The first shaft 6 and the second shaft 12 are arranged coaxially with the axis 140 of the disintegration apparatus and are driven in opposite directions on it in a manner that is not of interest in connection with the present invention. In the right-hand portion of FIG. 5 it can be seen that the central material input 4 surrounds the flange end 13 of the second shaft 12 as an annular ring. The first and second shaft 6, 12 are shown diagrammatically in the present embodiment as hollow shafts that are supported on a common solid shaft or axle, not shown herein. However, the invention can be used with coaxial floating shaft ends.

Between the annular shaft flanges 8 and 14 that are opposite and closely adjacent to each other, there is a labyrinth seal 16 that operates in a manner known per se, but not shown herein, with blocking air in order to avoid solid particles getting between the annular shaft flanges 8 and 14, where they would cause frictional losses and even damage.

The housing 2, 3, 5 is supported independently and separately from the shaft 6 and 12 and sealed off from these and from the material input 4 in a manner that is not of interest within the context of the present invention.

The outer rotor 18, 180 that is connected to the first shaft 6 consists, both in the bolted-up as well as in the cast version, of an outer assembly ring carrier 20 (FIG. 5) with an assembly ring 21, 210 for the second blade ring 22, 220 and an assembly ring 31, 310 which is concentric thereto, for the fourth blade ring 32, 320.

The inner rotor 46, 460 that is connected to the second shaft 12 consists of an inner assembly ring carrier 48 and an assembly ring 49, 490 for the first blade ring 50, 500 and an assembly ring 62, 620, which is concentric thereto, for the third blade ring 63, 630.

The blades 69, 690 of each blade ring 50, 500; 22, 220; 63, 630; 32, 320 are on the one side connected with the assembly ring 21, 210; 31, 310; 49, 490; 62, 620 and on the other with a retaining ring 115, 1150; 121, 1210; 126, 1260; 131, 1310. Each blade 69, 690 consists of a center piece 70, 700 and two hard, wear resistant front and rear edge rods 87, 98, which can be assembled with the assembly or retaining rings so as to be releasable, and which are adjacent to the center piece 70, 700.

The center piece is configured as a flat plate with an edge 73 that leads as viewed in the direction of rotation, and a rear edge 75. These edges have indentations 74 and 76 against which the casing surface of the front or rear edge rod 87, 98 is adjacent.

In a first embodiment, each center piece 70 of a blade has a flat mounting surfaces 71, 72 that are adjacent to the corresponding locations of the assembly or retaining ring. These mounting surfaces 71, 72 and the corresponding locations of the assembly or retaining rings can be ground so as to ensure a firm seat. The so-configured center pieces 70 of the blades 69 are bolted up with the assembly or retaining rings. To this end, in the assembly rings 49, 21, 62, 31 and the retaining rings 115, 121, 126, 131 there are countersunk holes 110, 119 for the flat heads 83 of the mounting screws 85. There are corresponding screw holes 84 in the center pieces 70 and these holes provide sufficient space for the air that is compressed when the mounting screws 85 are tightened (FIG. 8). The countersunk holes are indispensible if the flat heads 83 are located in annular indentations which, for reasons of flow technology, can be closed off by means of annular covers (not shown herein).

In a second embodiment, the center pieces 700 of the blades 690 with the assembly and retaining rings 490, 1150; 210, 1210; 620, 1260; 310, 1310 of the particular blade rings 500, 220, 630, 320 are cast (FIG. 9).

In the first embodiment, the outer rotor 18 and the inner rotor 46 are, in each instance, structures that are bolted up from the assembly ring carriers 20, 48 with the assembly rings 21, 31 or 49 and 62, respectively, center pieces 70 of the blades 69, and the retaining rings 115, 120, 126, 131, whereas in the second embodiment, the outer rotor 180 and the inner rotor 460 are in each instance monolithic cast units made up of the assembly ring carriers 20 and 48 with the assembly rings 210, 310, 490, 620, the center pieces 700 of the blades 690 and the retaining rings 1150, 1210, 1260, and 1310. The bolted-up rotors 18 or 46, respectively and the cast rotors 18 or 460, respectively, are interchangeable.

In both of these embodiments, the same front and rear edge rods 87 and 98, which can, in each instance be released, are used. Each edge rod 87, 98 is of essentially circular cross section 88 or 99, respectively, with the center line 89, 100 the outside surfaces of which, which face the particular center piece 70, 700 being adjacent to the indentations 74, 76.

One end of each rod 87, 98 is configured as an insertion end 90, 101 of a diameter that is smaller relative to the rod and with a ground annular contact surface 91, 102. When installed, these insertion ends fit with a very small clearance in insertion holes 118, 125, 130, 137 of the corresponding retaining rings 115, 121, 126, 131 or 1150, 1210, 1260, 1310, respectively (FIGS. 8 and 9).

The end of each rod 87, 98 that is opposite to the insertion end 90, 101 is configured as a tightening end 92, 103 which is of equal diameter to the rod 87, 98, although with an inclined area 93 or 104, respectively. The tightening ends 92, 103 of the rods 87, 98 are secured in the corresponding assembly ring 21, 210; 31, 310; 49, 490; 62, 620; so as to be releaseable. To this end, there are drilled holes 119 (FIGS. 8, 9, 12) in these assembly rings and, adjacent to these, drilled holes 112 to accommodate a clamping piece 109 with an incline 113 for the inclined area 93 or 104, respectively, of the tightening ends 92 or 103, respectively, of the associated edge rod 87, 98. Countersunk head screws 114 are provided to secure the clamping pieces 109 within the assembly rings 21, 210, 31, 310, 49, 490; 62, 620.

The individual parts of the blades 69, 690 are so configured as to simplify the installation of protective layers 142 (FIGS. 10, 11) from the material to be disintegrated. In particular, at least the working surface 78 of each center piece 70, 700 is provided with a roughened surface 79, in preferred embodiments in the form of sawtooth-like transverse grooves 80. As a rule, the at least surface hardened front and rear edge rods 87, 98 have roughened surfaces 97 or 108.

In order to simplify the installation of the protective layers 142, each front edge rod 87 has an elongated slot 94 and a material contact surface 96 that extends nearly radially to the disintegration shaft 140. This elongated slot 94 has a cross section 95 in the form of a right-angle triangle. In addition, each rear edge rod 98 has an elongated slot 105 and a material contact surface 107 that is also almost parallel to the disintegration shaft 142. This elongated slot 105 also has a cross section 106 in the form of a right-angle triangle.

The arrangement of the elongated slots 94, 105 in the edge rods 87, 98, the position of the inclined areas 93 and 104 in their tightening ends 92, 103, as well as the incline 113 on the clamping pieces 109 are so matched that the material contact surfaces 96, 107 of a new rod always moves into the correct position related to the direction of rotation after replacement, as can be seen in FIGS. 8 to 12. After the removal of a used front or rear edge rod 87, 98, the new edge rod is inserted through the drillings 111 in the assembly rings 21, 210; 31, 310; 49, 490; 62, 620, until the insertion end 90, 101 is seated in the insertion hole 108, 125, 130, 137. Then, the rod 87, 98 is rotated about its center line 89, 100 until, in each instance, the inclined area 93, 104 lies on the tightening ends 92, 103 parallel to the incline 113 on the associated clamping piece 109. Then, the clamping piece 109 is screwed tight. This final position of the tightening ends 92, 103 of the front and rear edge rods 87, 98 can be seen clearly in FIG. 12 on the assembly rings 210 and 31. A cast center piece 700 of a blade 690 is shown in conjunction with the center ring 21 and a bolted-up center piece 70 of a blade 69 of the fourth blade ring 32 is shown in conjunction with the assembly ring 31. The removal of worn edge rods and the installation of new ones can take place when the rotors are bolted in, providing appropriate installation openings (not shown herein) are provided in the housing walls 2 and 3.

In addition, FIG. 12 shows that the connecting lines between the center lines 89, 90 of the front and rear edge rods opposite the center lines of the center pieces 70, 700 are offset slightly towards the disintegration axis 140, not shown in FIG. 12. In order to facilitate the removal of a protective layer 142, as can be seen clearly in FIGS. 3 and 4 and 10 and 11.

The working surfaces 78 of the blades 69, 690 form an angle between 20 and 30 to the direction of rotation relative to the tangent on the edge r of the associated assembly or retaining ring at the point adjacent to the front or rear edge rod 87, 98, wherein the size of this angle depends on the hardness of the material that is to be disintegrated or the peripheral speed of the particular blade ring. Of particular importance is the fact that between the front edge rods 87 of the blades 69, 690 and the edge r of the particular assembly or retaining ring there is a front interval v, and between the rear edge rod 97 and the corresponding edge r of the assembly or retaining ring a rear distance h is maintained.

None of the heads of the screws extends beyond the surface of the assembly or retaining rings. Thus, the flat heads 83 of the mounting screws 85 lie completely within the countersink holes 110. Countersunk head screws 114 are used to secure the clamping pieces 109. All of these screws 85, 114 are socket head cap screws.

In preferred embodiments of the invention, the screw heads or screw holes can also be closed off by covers for the annular indentations, so that the screw heads cause no harmful vortexes in the nominal rotational speed range.

The center pieces 70, 700 of the blades 69, 690 of the fourth blade ring have ventilator extensions 77, 770 in front, in the direction of rotation, which on the one hand effect the optimal removal of the disintegrated solid particles into the impact chamber 68 but, on the other, ensure that the desired pressure conditions can be maintained in the nominal rotational speed range within the disintegration chamber 139, 68, and form the fourth vortex zone 150 which, within the nominal speed range, also prevents reduced material falling back onto the fourth blade ring.

FIG. 2 shows that in the preferred embodiment, the blade lengths 81 of all the blades 69, 690 is equal in all the blade rings. The distances 82 between the blades 69, 690 are equal, regardless of the blade ring. However, as can be seen 25 from FIGS. 6 and 7, the widths $143_1$, $143_2$, $143_3$, $143_4$ of the blades increase outwards from blade ring to blade ring which makes allowance for the increase in volume of the gas-solids mixture during disintegration in the disintegration chamber 139 beneath the impact chamber 68.

In the context of the present invention, particular value has been placed on the configuration of this part of the rotary disintegration apparatus 1.

The inner surfaces 117, 23, 129, 33, 51, 124, 64, 136 of the retaining and assembly rings 115, 1150; 21, 210; 126, 1260; 31, 310; or 49, 490; 121, 1210; 62, 620; 131, 1310 that follow each other in alternation are smooth and form the side walls, which grow wider towards the outside, of the disintegration chamber 139 beneath the impact chamber 68 from blade ring to blade ring 50, 500; 22, 220; 63, 630; 32, 320. This is possible mainly because in addition to the assembly rings the outer installation ring carrier 20 and the inner installation ring carrier 48 also accommodate annular bulges to accommodate the retaining rings of the other rotor in each case.

In detail, the outer assembly ring carrier 20 that is flange mounted onto the first shaft 6, in addition to both concentric installation rings 21, 210 and 31, 310 for the second and fourth blade rings 22, 220 or 32, 320, respectively, also has an annular bulge 25 for the retaining ring 115, 1150 of the first blade ring as well as an outer pressure relief ring 35 to accommodate the retaining ring 126, 1260 of the third blade ring.

Accordingly, the inner assembly ring carrier 48 that is driven by the second shaft 12, in addition to the two concentric installation rings 49, 490; 63, 630 for the first or third blade ring also has an inner pressure relief ring 57 to accommodate the retaining ring 121, 1210 of the second blade ring. The retaining ring 131, 1310 for the fourth blade ring runs freely above the assembly ring 62, 620 for the third blade ring.

The radial gap between the inner and outer edges r that face each other in each instance of the assembly and retaining rings that follow each other outwards are kept as small as possible. They are just big enough to permit trouble-free installation or removal of the disintegration apparatus 1.

If, for any reason, solid particles should escape from the disintegration chamber 139 through this narrow annular gap, the special configuration of the edge areas of the annular gap ensures that the solid particles are fed back into the disintegration process. To this end, the side walls of the annular bulges for the retaining rings 115, 1150 of the first blade ring and the outer and inner pressure relief ring chambers 35, 57 to accommodate the retaining rings 126, 1260; 121, 1210 of the third and second blade rings are configured as outer and inner truncated conical housings 26, 36, 39, 58, 61, the larger diameters of which in each instance facing towards the disintegration chamber 139. In the same manner, the outer side wall of the retaining ring 115, 1150 of the first blade ring is configured as the outer truncated conical housing 116 and the side walls of the retaining rings 121, 1210; 126, 1260 of the second and third blade rings and the outer side wall of the retaining ring 131, 1310 for the fourth blade ring is configured as the inner or outer truncated conical housing 121, 123; 127, 128; 134 of which, in each instance, the larger diameter faces towards the disintegration chamber 139. Appropriate annular indentations result from these annular bulges in the outer assembly ring carrier 20 and within the inner assembly ring carrier 48. Within the outer assembly ring carrier 20 there is, in addition to the second blade ring 22, 220 an annular indentation 27 with a bottom 28 and with an inner truncated conical housing 29 and with an outer truncated conical housing 30. Adjacent to the fourth blade ring 32, 320 there is an annular indentation 40 with a bottom 41 and an inner truncated conical housing 44. The installation ring 31, 310 and the retaining ring 131, 1310 for the fourth blade ring 32, 320 are each closed off with a paraxial outer casing 135. In addition, there is an annular extension 138 on the retaining ring 131, 1310.

Within the inner installation ring carrier 48, in addition to the first blade ring 50, 500, there is an annular indentation 52 with a bottom 53 and with an outer truncated conical housing 54 that is provided as a side wall that is opposite an inner paraxial side wall 55. An annular indentation 65 with a bottom 66 lies next to the third blade ring 63, 630. The installation ring 62, 620 ends in a truncated conical housing-like annular end surface 67.

Figure 1:
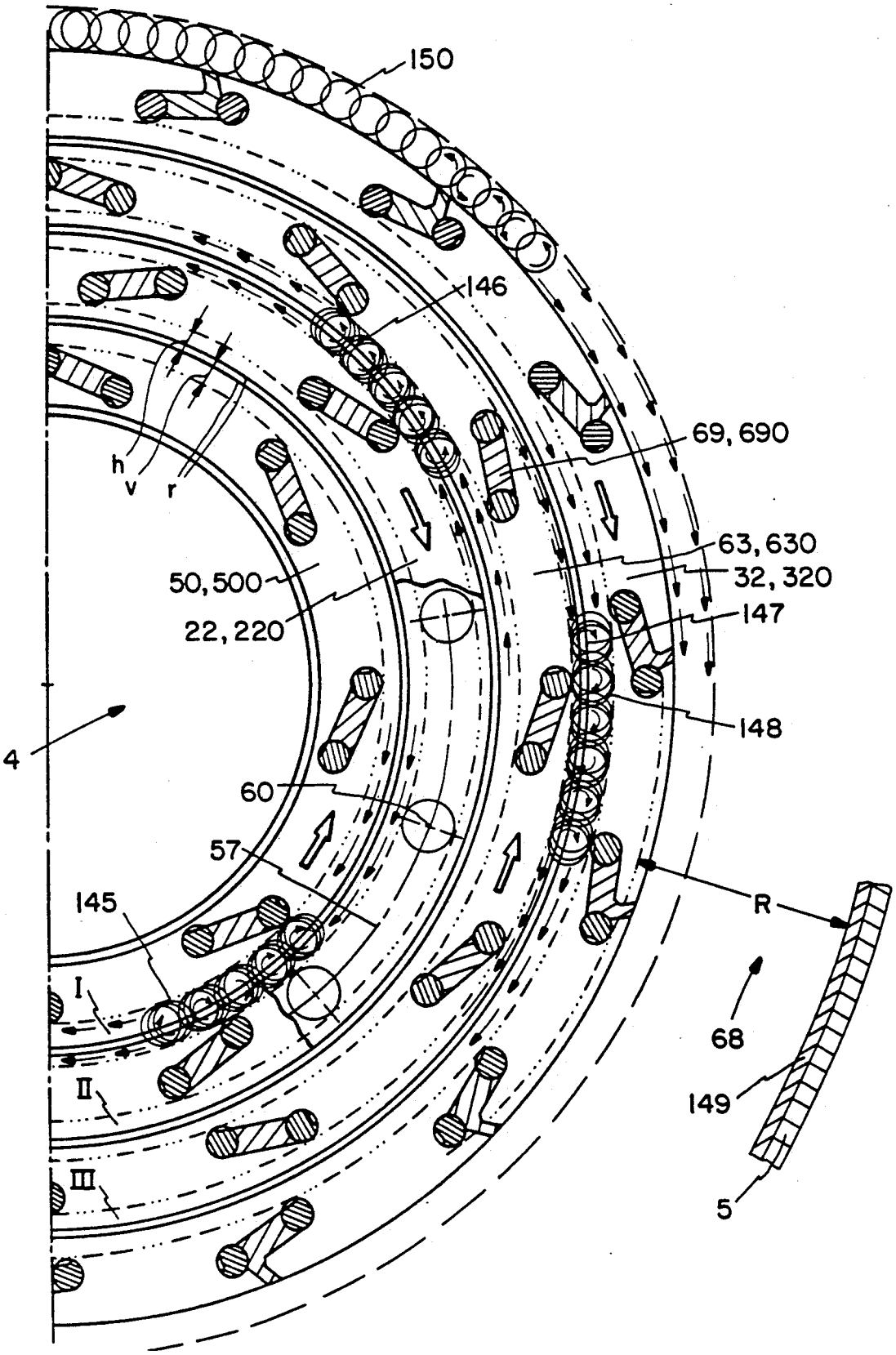
FIG. 1 is a partial plan view on the line I—I in FIG. 5 of a preferred embodiment of a rotary disintegration apparatus.

A further special feature of the rotary disintegration apparatus 1 according to the present invention is the fact that pressure relief ports 38 are provided in the bottom of the outer annular pressure relief chamber 35 and pressure release openings 60 are provided in the bottom 59 of the inner annular pressure relief chamber 57. The latter are shown in FIG. 1, the former in FIG. 12, in both instances as circular openings. Without in any way changing anything regarding the underlying concept of the present invention, the pressure relief ports can be of any other useful configuration. Their edges are chamfered on both sides so as to facilitate the flow through said ports.

Of particular advantage is the fact that the pressure relief ports 28 or 60, respectively, are covered relative to the disintegration chamber 139 by the retaining rings 120, 1210 or 126, 1260. This prevents solid particles being carried through in the event of pressure equalization between the disintegration chamber 139 and the area between the outer side of the outer installation ring carrier 20 and the first housing wall 2 and the outer side of the inner assembly ring carrier 40 and the second housing side wall 3. Pressure equalization between the disintegration chamber 139 and the above-mentioned outer areas of the rotary disintegration apparatus 1 is necessary for the proper disintegration of the solid particles. The first and the second blade rings 50, 500 or 22, 220 are closed at the inner annular pressure relief chamber 57 with the pressure relief port 60 and the third and the fourth blade ring 63, 630 or 32, 320, respectively, are closed at the outer annular pressure relief chamber 35 with the pressure relief ports 38. In the preferred embodiment, each pressure relief chamber 35, 57 (FIG. 1) has as many pressure relief ports 38, 60 as are required to maintain the desired reduction of gas temperature (a function of rotational speed). The diameter of the circular pressure relief ports are slightly smaller than the width of the bottom of the annular pressure relief chambers 35, 57. The pressure relief ports can be contoured as designed. However, a circular form is preferred for reasons of manufacturing technology.

The method of operation of the rotary disintegration apparatus is explained below in conjunction with FIG. 1. The blades in the individual blade rings and the direction of rotation of these blade rings are such that when idling at nominal rotational speed, i.e., when the peripheral speed of the outer ring is greater than or equal to 130 m/sec, the next innermost following rotor is running at the same speed in the opposite direction and this moves the gas from the outside inwards. Thus, initially, the disintegrator can be regarded as a four-stage radial blower configured to run in a radial direction. When this takes place, the outermost rotor in each instance supplies more gas radially inwards than the next innermost rotor that follows radially can move forward. For this reason, pressure builds up in the annular chambers III, II, I in which annular vortices (comparable to the rollers in a rolling mill) result because of the frictional effects of the adjacent rotors. Another explanation for the build-up of pressure in the annular chambers III, II, I stems from the fact that a dynamic pressure is generated in the blade channels of the individual blade rings 32, 320; 63, 630; 22, 220; and 50, 500 and this is converted to a static pressure in the annular chambers III, II, I where there are no blades and this pressure, as in a radial blower, for example, is greater than in the channels between the blades 69, 690. The configuration of the vortex zones, shown mainly in FIG. 1, and corresponding to the image of a rolling mill, can be made visible by a simple test in a transparent operating model with a rotor that is open on one side. The pressure in the annular zones is at least 1 bar greater than in the adjacent areas of the blade rings. In order to stabilize the vortices within the annular zones, the annular gaps between the assembly or retaining rings are used and these are so dimensioned that the absolute pressure in the annular zones does not exceed 3 bar. It can be seen from the figures that the impact chamber 68 that follows the fourth blade ring 32, 320 is defined to the outside by the housing end wall 5 or the wear panels 149. The radial length R of the impact chambers 68 from the outermost blade ring 32, 320 to the end wall 5 of the housing is at least as long as the sum of the radial walls of the outer assembly or retaining rings that follow each other.

When the disintegrator is loaded with solids through the material input 4, particles are moved radially from the inside outwards as a result of centrifugal force, whereupon they carry along significant parts of the air flow that moves from the outside inwards, so that an air/solids mixture (carrier airflow) is formed, wherein this flow is directed radially from the inside to the outside and overcomes the feed force of the blades that is oriented from the outside inwards. This gas/solids mixture passes through the vortex zones I, II, and III. In order not to hinder the formation of the vortex zones, the side walls that widen towards the outside are provided and the annular pressure relief chambers are configured so that ingress of the solids particles into the annular gaps is to a large extent prevented. The penetratability of the individual blade rings is thus matched to each other in that the intervals 82 between the individual blades in all the rotor blades are equal.

Because of the special configuration of the inner surfaces of the assembly or retaining rings of the blade rings that follow each other, separated by the particular annular gap, in alternation there is an incremental widening of the disintegration chamber which means that the flow of material from the inside outwards takes place without any disruption. The annular chambers I, II, and III create not only spaces for the gas/solids vortices that are forming, but also define those areas in the disintegration chamber in which the static pressures are set up, which are higher than the dynamic pressures within the blade channels and which are an important prerequisite for the formation of the vortex zones shown in FIG. 1.

It is apparent that the main reduction work takes place within the annular chambers I, II, and III. This reduction work is facilitated in that, because of their inclination, the blades exert a conveying force in a radial direction from the outside inwards, so that within the annular chambers, disruptive effects relative to the flow of carrier air are formed and these enhance the reduction work.

Tests have shown that up to 65% of the total reduction work is done in the vortex zones 145, 146, and 147. In contrast to this, only a small amount of reduction work takes place on the blades 69 and 690 of the individual blade rings. The blades impart essentially tangential accelerations to the solid particles. Since the particles are simultaneously acted upon by centrifugal force, they migrate outwards from vortex zone to vortex zone. The individual vortex zones 145, 146, and 147 also complete a migration within their annular chambers as is indicated by the arrow in the peripheral direction and which are caused by the higher peripheral speed, albeit slight, of the blade ring that is, in each instance, next towards the outside.

On the far side of the fourth outer blade ring 32, 320 the solid particles follow a path that is indicated with the number 148 into the impact chamber 68 in which the vortexing particles settle down and are guided either along the wear panels 149 or on the housing 5. Within the impact chamber 68, a further, fourth vortex zone 150 is formed, in which a further reduction of the solid particles takes place. The residual reduction work takes place together with the reduction caused by impact of the solid particles on the blades 69, 690 or on their protective layers 142.

Within the impact chamber 68, solid particles are not only subjected to reduction but their crystal structure undergoes a more or less great change. Furthermore, within the impact chamber there may be a gas exchange between the solid particles and the gas fraction of the gas/solids mixture. Either oxygen can build up on the reduced particles which then activates these, or oxygen can be drawn off from the solid particles. In contrast, if the reduction takes place in an atmosphere of inert gas, it can happen that the reduced solids particles will be inert. According to the present invention, the material properties that are imparted to the solids particles within the impact chamber 68 remain with the solids particles for a considerable period of time.

The optimal configuration of the vortex Zones 145, 146, 147, and 150, and thus the optimal reduction result in the nominal speed range in which, on the outer blade ring 32, 320, peripheral speeds of greater than 130 m/sec (260 m/sec in a counter-rotating system) are achieved. During the reduction in the disintegration apparatus according to the present invention, a porous or amorphous surface that contributes greatly to the so-called activation of the particles is imparted to the solids. Prior to the beginning of a disintegration or processing of the solid particles, one must therefore decide in which gas atmosphere the reduction is to take place.

Nominal rotational speed range is to be understood to mean not the nominal rotational speed of the drive motors, but the rotational speed range below this that results because of the input of material into the disintegration apparatus. The disintegration apparatus is monitored by a process computer which ensures that during each material input the resulting reduced rotational speed of the rotors is very rapidly corrected. If the rotational speed drops below the nominal speed range, this results in the fact that the main reduction work is then done predominantly by the impact of the solid particles on the blades. The nominal rotational speed and the nominal rotational speed range are governed essentially by the specific weight and hardness of the material being processed.

The embodiments of the invention in which an exclusive property of privilege is claimed are defined as follows:

1. A rotary disintegration apparatus comprising a housing with a central material input and a material outlet open underneath, an inner rotor fixed to a fist shaft and an outer rotor fixed to a second shaft on the same axis that rotates in the opposite direction, and blade rings that follow each other in alternation, said blade rings having blades which are inclined relative to the direction of rotation, the blades having front and rear edges of hard wear-resistant material, and which sit on one side on retaining rings and on the other side on assembly rings forming replaceable components of annular assembly ring carriers that are connected to the shafts, si blades being so arranged at a distance from the edges of the assembly and retaining rings of their blade rings that the front edges of the blades of a blade ring and the rear edges of the blades of the following blade ring which rotates in the opposite direction define annular chambers within a disintegration chamber, within which, within a nominal speed range of the rotors, vortex zones of the gas-solids mixture are formed.

2. A disintegration apparatus as claimed in claim 1, wherein the disintegration chamber includes an outer impact chamber that is defined inwardly by the front edges of the blades of the outer blade ring and outwardly by the end wall of the housing that connects the side walls of the housing to form an additional vortex zone in the nominal speed range.

3. A disintegration apparatus as claimed in claim 2, wherein the radial length between inner and outer limits of the impact chamber is at lest equal to the radial length of the two outer assembly or retaining rings.

4. A disintegration apparatus as claimed in any of claims 1 to 3, wherein the inner surfaces of the retaining and assembly rings that follow each other in alternation are smooth and form the side walls of the disintegration chamber that grow wider from blade ring to blade ring to the outside of the disintegration chamber beneath the impact chamber.

5. A disintegration apparatus as claimed in claim 1, wherein the outer rotor has an outer assembly ring carrier with two concentric assembly rings for second and fourth blade rings, the outer assembly ring carrier being flange mounted on the first shaft, and an annular bulge for the retaining ring of the first blade ring and an outer annular pressure relief chamber to accommodate the retaining ring of a third of the blade rings.

6. A disintegration apparatus as claimed in claim 5, wherein the inner rotor has an annular flange that is flanged onto the second shaft and an inner assembly ring carrier with two concentric assembly rings for the first and the third blade ring which is secured thereon by means of the first blade ring and an annular pressure relief chamber to accommodate the retaining ring for the second blade ring.

7. A disintegration apparatus as claimed in claim 6, wherein side walls of the annular bulge for the retaining ring of the first blade ring and the outer and inner annular pressure relief chambers to accommodate the retaining rings of the third and second blade ring comprise outer or inner truncated conical housings, of which in each instance the greater diameter lies towards the disintegration chamber.

8. A disintegration apparatus as claimed in claim 7, wherein an outer side wall of the retaining ring of the first blade ring comprises an outer truncated conical housing, and side walls of the retaining ring of the second and third blade rings and outer side walls of the retaining ring for the fourth blade ring comprise inner or outer truncated conical housings, of which in each instance the greater diameter lies towards the disintegration chamber.

9. A disintegration apparatus as claimed in claim 1, wherein covered pressure relief ports are provided within bottoms of pressure relief chambers of the retaining rings of the blade rings.

10. A disintegration apparatus as claimed in claim 9, wherein the pressure relief ports have edges which are chamferred on both sides.

11. A disintegration apparatus as claimed in the claim 9 or 10, wherein each annular pressure relief chamber has as many pressure relief ports as are necessary for maintaining the desired reduction of the gas temperature, which is a function of rotational speed.

12. A disintegration apparatus as claimed in claim 1, wherein each blade is combined from a center piece connected to the assembly ring, the retaining ring of a particular blade ring, and two hard, wear-resistant front and rear edge rods, which are adjacent to the center piece and which can be assembled with these rings so as to be detachable.

13. A disintegration apparatus as claimed in claim 12, wherein each center piece has a working surface, and wherein at least the working surfaces of the center pieces of the blades have a roughened surface.

14. A disintegration apparatus as claimed in claim 13, wherein the roughened surface of each center piece has saw-tooth, transverse grooves.

15. A disintegration apparatus as claimed in claim 12 wherein the center pieces of the blades of the outer blade ring have a ventilator extension that is arranged in front, as viewed in the direction of rotation.

16. A disintegration apparatus as claimed in claim 12, wherein the dimensions of the center pieces of the blades are equal, apart from the width of the blades that increases from the inner to the outer blade ring.

17. A disintegration apparatus as claimed in claim 12, wherein the center piece of each blade is a flat plate with a front edge and a rear edge.

18. A disintegration apparatus as claimed in claim 12 or 17, wherein the center pieces of the blade are cast with the associated assembly and retaining rings of the particular blade ring so that the outer rotor and the inner rotor are in each instance monolithic castings.

19. A disintegration apparatus as claimed in claim 18 wherein the cast rotors are replaceable by bolted up rotors.

20. A disintegration apparatus as claimed in claim 12, wherein the center pieces of the blades have flat mounting surfaces and are bolted up with the associated assembly and retaining rings of the particular blade ring.

21. The disintegration apparatus as claimed in claim 20, wherein the bolted up rotors are replaceable by cast rotors.

22. A disintegration apparatus as claimed in claim 20, wherein the mounting surfaces on the center piece of each bolted up blade are ground to a precise fit.

23. A disintegration apparatus as claimed in claim 12, wherein each front edge rod and each rear edge rod is of essentially circular cross section and wherein front and rear edges of the center pieces have fitted indentations for contact with the associated edge rods.

24. A disintegration apparatus as claimed in claim 12, wherein each front edge rod has an elongated slot to accommodate a protective layer with a material contact surface that runs approximately radially to a disintegration shaft.

25. A disintegration apparatus as claimed in claim 24, wherein the elongated slot of each front edge rod has a cross section in the form of a right angle triangle.

26. A disintegration apparatus as claimed in claim 24, wherein each rear edge rod has an elongated slot to accommodate a protective layer with a material contact surface that runs approximately parallel to the disintegrator shaft.

27. A disintegration apparatus as claimed in claim 26, wherein the elongated slot of each rear edge rod has a cross section in the form of a right angle triangle.

28. A disintegration apparatus as claimed in claim 24 wherein connecting lines between the center line of the front and rear edge rods are displaced slightly towards the disintegration shaft relative to the center lines of the center pieces.

29. A disintegration apparatus as claimed in claim 12 wherein the front and rear edge rods on one end have insertion ends of reduced diameter and a ground annular contact surface.

30. A disintegration apparatus as claimed in claim 29, wherein the front and rear edge rods have at another end tightening ends which are of the same diameter as the rods, although with an inclined area.

31. A disintegration apparatus as claimed in claim 30, wherein there are first drilled holes in the assembly rings for the tightening ends of the front and rear edge rods and adjacent to each of the first drilled holes second drilled holes to accommodate a clamping piece with an incline for the inclined areas of the front and rear edge rods.

32. A disintegration apparatus as claimed in claim 31, wherein countersunk head screws secure the clamping pieces in the assembly ring.

33. A disintegration apparatus as claimed in claim 32, wherein the screws are socket head cap screws.

34. A disintegration apparatus as claimed in claim 30, wherein insertion holes for the insertion ends of the front and rear edge rods are arranged in the retaining rings.

35. A disintegration apparatus as claimed in claims 1 to 3, wherein at least the surface of the foremost and rearmost edge rods is partially roughened hardened, and ground on the rounded portions.

36. A disintegration apparatus as claimed in any of claim 1 to 3, wherein in the assembly rings and the retaining rings there are countersink holes for flat heads of mounting screws that are used to secure the assembly surfaces of the bolted-up blades.

37. A disintegration apparatus as claimed in any of claims 1 to 3, wherein the intervals between the blades in all the blade rings are equal.

38. The disintegration apparatus as claimed in claim 1, wherein the blades are covered with a protective layer.

39. In a rotary disintegration apparatus surrounded by a housing, the apparatus including an outer rotor driven by a first shaft and an inner rotor driven by a second shaft, the first and second shafts being located on an identical axis, the rotors being located opposite each other and being driven in opposite directions, inner and outer assembly ring carriers being flanged to the shafts, assembly rings being mounted on the assembly ring carriers, and blades having bottom ends and top ends and front and rear edges, the assembly rings receiving the bottom ends of the blades, the blades being upwardly inclined in the direction of rotation, the top ends of the blades facing the oppositely located rotor being fastened to retaining rings, the front and rear edges of the blades being of hard wear-resistance material, the assembly rings and the retaining rings having edges, the blades being mounted spaced from the edges of the assembly rings and the retaining rings, the assembly rings and the retaining rings having inner surfaces, wherein the inner surfaces of successive assembly rings and retaining rings and annular gaps defined between the rings form side walls of a disintegration chamber, wherein the blades are components of blade rings which are arranged successively from the inside toward outside and which rotate alternatingly in opposite directions, the improvement comprising the inner surfaces of the assembly rings and the retaining rings being smooth, wherein the distances between the smooth inner surfaces of the assembly rings and the retaining rings increase from blade ring to blade ring, wherein always two successive assembly rings are connected to each other to form an assembly ring carrier, the assembly rings being connected through truncated cone-shaped walls and a bottom of an annular pressure relief chamber located between the assembly rings and coverable by means of a retaining ring of the oppositely located rotor, wherein the truncated cone-shaped walls of the pressure relief chambers and of the annular gaps extend upwardly inclined toward the disintegration chamber, whereby scattered grain is returned into annular chambers between the blade rings, the annular chambers being defined in radial direction by blade edges of the blade rings which face each other and in axial direction by circular rings having a width which is between the blade edges and the edges of the assembly rings and the retaining rings and in which rotating vortex zones of a gas-solid mixture are formed at a nominal speed range, the vortex zones being in connection with the annular pressure relief chambers which acts as stabilizer and pressure compensators.

40. The disintegration apparatus according to claim 39, wherein the outer assembly ring carrier is flanged by means of an annular flange to an annular shaft flange of the first shaft, and wherein the outer assembly ring carrier has a circular bulge with an outer truncated cone-shaped wall for the retaining ring of the first of the blade rings at the inner assembly ring carrier, and wherein the latter retaining ring is flanged by means of an annular flange to an annular shaft flange of the second shaft.

41. The disintegration apparatus according to claim 39, wherein the blades are coated with a protective layer.

* * * * *